United States Patent [19]

Cafolla

[11] Patent Number: 4,529,376

[45] Date of Patent: Jul. 16, 1985

[54] CANDLE CONSTRUCTION

[76] Inventor: Mark S. Cafolla, P.O. Box 86, Waterloo, N.Y. 13165

[21] Appl. No.: 557,008

[22] Filed: Dec. 1, 1983

[51] Int. Cl.[3] ..... F23D 3/24

[52] U.S. Cl. ..... 431/320; 431/125; 431/298

[58] Field of Search ..... 431/298, 320, 125

[56] References Cited

U.S. PATENT DOCUMENTS

| | | | |
|---|---|---|---|
| 397,011 | 1/1889 | Leynen-Hougherts | 431/298 |
| 3,315,497 | 4/1967 | MacDonald | 431/320 |
| 3,790,332 | 2/1974 | Woollard | 431/298 |
| 4,013,397 | 3/1977 | Neugart | 431/298 |
| 4,185,953 | 1/1980 | Schirneker | 431/320 |

*Primary Examiner*—Carroll B. Dority, Jr.

*Attorney, Agent, or Firm*—Charles S. McGuire

[57] ABSTRACT

A candle structure for burning a fuel which is liquid at room temperature includes a hollow enclosure which alternatively may contain the fuel being consumed or may float upon the fuel, and rigid wick means, preferably in the form of one or more charcoal rods, supported with the upper end above the enclosure. The wick means extends into the enclosure, with its lower end either inside the enclosure, when the latter contains the flammable liquid, or extending through a lower wall of the enclosure when floating upon the liquid. Additional features include construction of the enclosure and/or the container in various decorative forms, and cooperative structure on a floating enclosure and on the fuel container for rotating the enclosure as it moves downwardly as the fuel is consumed.

9 Claims, 4 Drawing Figures

CANDLE CONSTRUCTION

BACKGROUND OF THE INVENTION

The present invention relates to candle constructions employing rigid wick means with a wick support which may either contain or float upon a liquid fuel.

The principal object of the invention is to provide decorative and interesting candle structures having rigid wicks supported upon a hollow enclosure which alternatively may contain a fluid fuel or may float upon the fuel in a larger container.

Another object is to provide a candle structure wherein a wick support floats upon a liquid fuel and rotates as it descends during consumption of the fuel.

A further object is to provide a candle structure including a wick support in the form of a model of a physical object, with one or more solid wicks extending from the support and forming a part of the model.

Other objects will in part be obvious and will in part appear hereinafter.

SUMMARY OF THE INVENTION

In accordance with the foregoing objects, the invention contemplates a candle structure having a solid, rigid wick, preferably in the form of one or more charcoal rods, extending upwardly from a hollow, enclosed body providing the wick support. The hollow wick support is adapted to contain a liquid fuel which contacts a lower portion of the wick and rises therethrough for combustion at the upper end. The wick support may take any of a variety of shapes, including that of a model of some physical object, in which case the wick means may form part of the model.

Instead of containing the liquid fuel, the hollow wick support may float upon the fuel in a container larger than the support, with the wick extending completely through the support, into the fuel. Also, cooperative structure may be provided on the wick support and container to produce movement such as rotation of the support means as it descends in the container as fuel is consumed.

DETAILED DESCRIPTION

Figure 1:
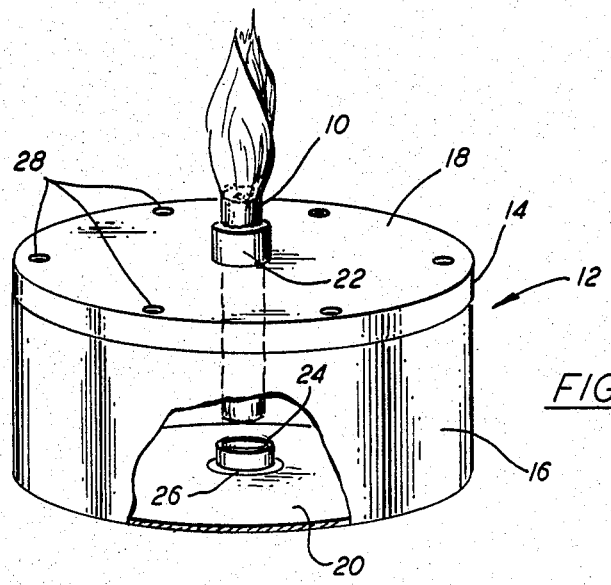
FIG. 1 is a perspective view of a first embodiment of the candle structure of the invention.

Referring now to the drawings, in FIG. 1 is shown a candle construction comprising wick 10 supported by structure denoted generally by reference numeral 12 in the form of a cylindrical body of plastic, metal, glass, or other suitable material, fabricated in mating, separable, upper and lower portions 14 and 16, respectively. Top wall 18 and bottom wall 20 each include centrally disposed openings, the top wall opening being aligned with the open center of annular member 22 which is affixed to and extends upwardly from top wall 18. The opening in bottom wall 20, in the form illustrated in FIG. 1, is closed by plug 24 which may comprise a resilient plastic or rubber member which sealingly engages resilient grommet 26 which is engaged with the periphery of the bottom wall opening.

Wick 10 is a rigid material, and may conveniently comprise a rod of porous charcoal through which a conventional fuel which is liquid at room temperature will travel by capillary action. The cross section of wick 10 may be chosen to fit snugly within annular member 22 and be supported thereby, or the wick may fit loosely within the annular member with the lower end of the wick resting upon plug 24. Support structure 12 may be fully or partially filled with a suitable liquid fuel and rest upon a flat supporting surface. If plug 24 extends past the plane of bottom wall 20, the latter may be made slightly concave so that the plug does not affect stability of the support structure on a flat surface. Vent openings 28 may be provided in top wall 18, particularly if wick 10 fits tightly within annular member 22.

Figure 2:
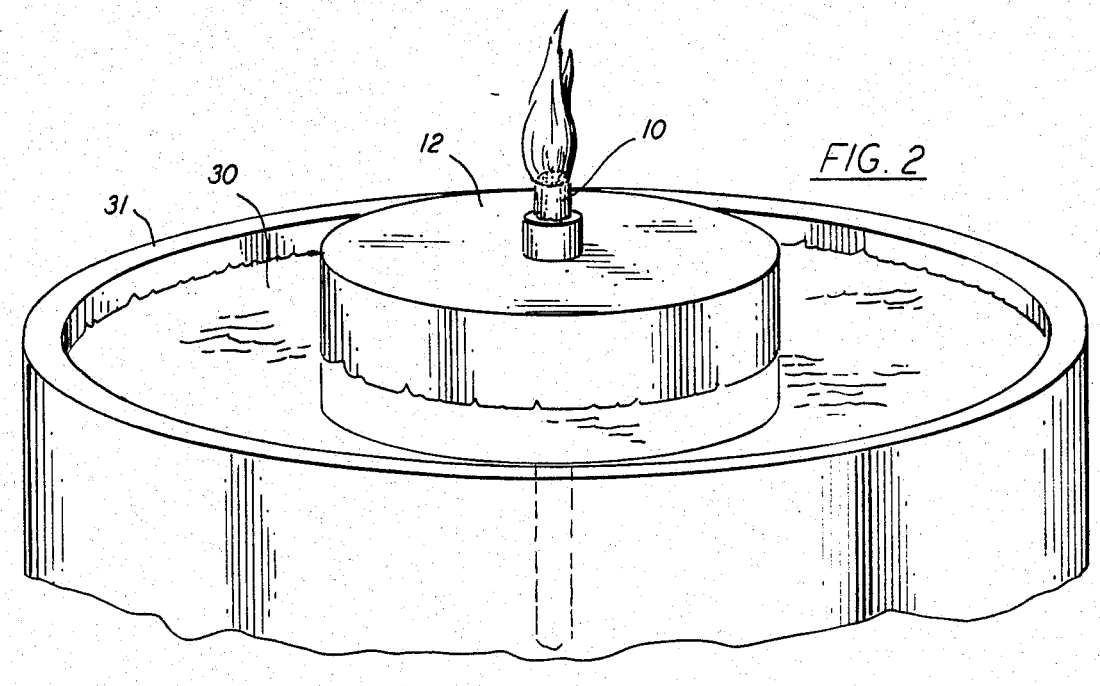
FIG. 2 is a fragmentary, perspective view of the candle structure of FIG. 1 in combination with other structure.

Plug 24 may be removed, and wick 10 inserted through the openings in both top and bottom walls 18 and 20, as shown in FIG. 2. In this case, wick 10 must not only be of sufficient length to extend outside both sides of support structure 12, but must be of proper cross section to engage grommet 26 in sealing engagement. Liquid fuel 30 is placed in container 31, of any desired size and shape larger than support structure 12, and the latter will float upon the fuel which will travel through wick 10 for combustion at the upper end.

Figure 3:
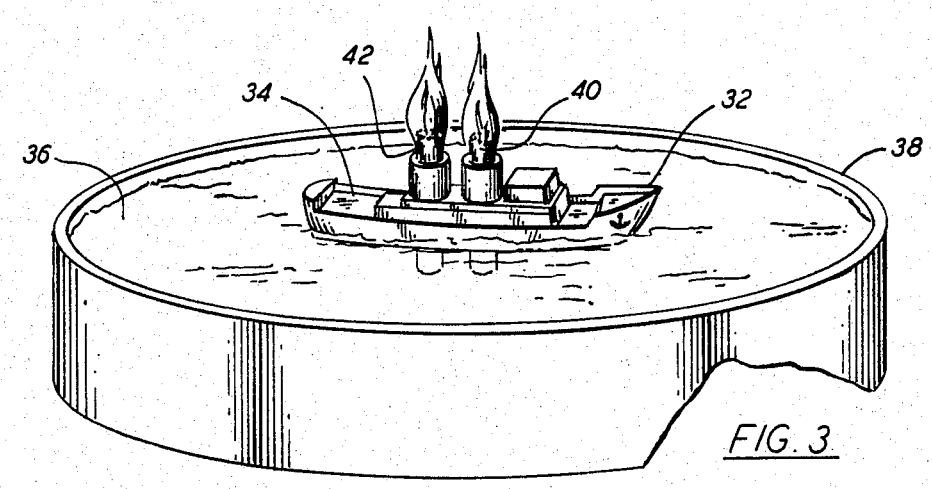
FIG. 3 is a perspective view of another form of the candle structure.

Instead of the regular cylindrical form of support structure 12 shown in FIGS. 1 and 2, a variety of other geometrical shapes, as well as miniature models of physical objects may be used as the wick support. In FIG. 3, for example, is shown a model steamship 32, which may be formed with a removable upper housing 34 to permit access to the hollow interior, which provides the necessary buoancy when ship 32 is floated upon fuel 36 within container 38. A pair of wicks 40 and 42 extend through openings in the top and bottom of model ship 32 when floating upon fuel in a separate container, and the lower openings may be sealed by appropriate plugs, with the fuel carried inside the body of the ship with the latter resting on a support surface in the same manner as support structure 12 in the form illustrated in FIGS. 1 and 2.

Figure 4:
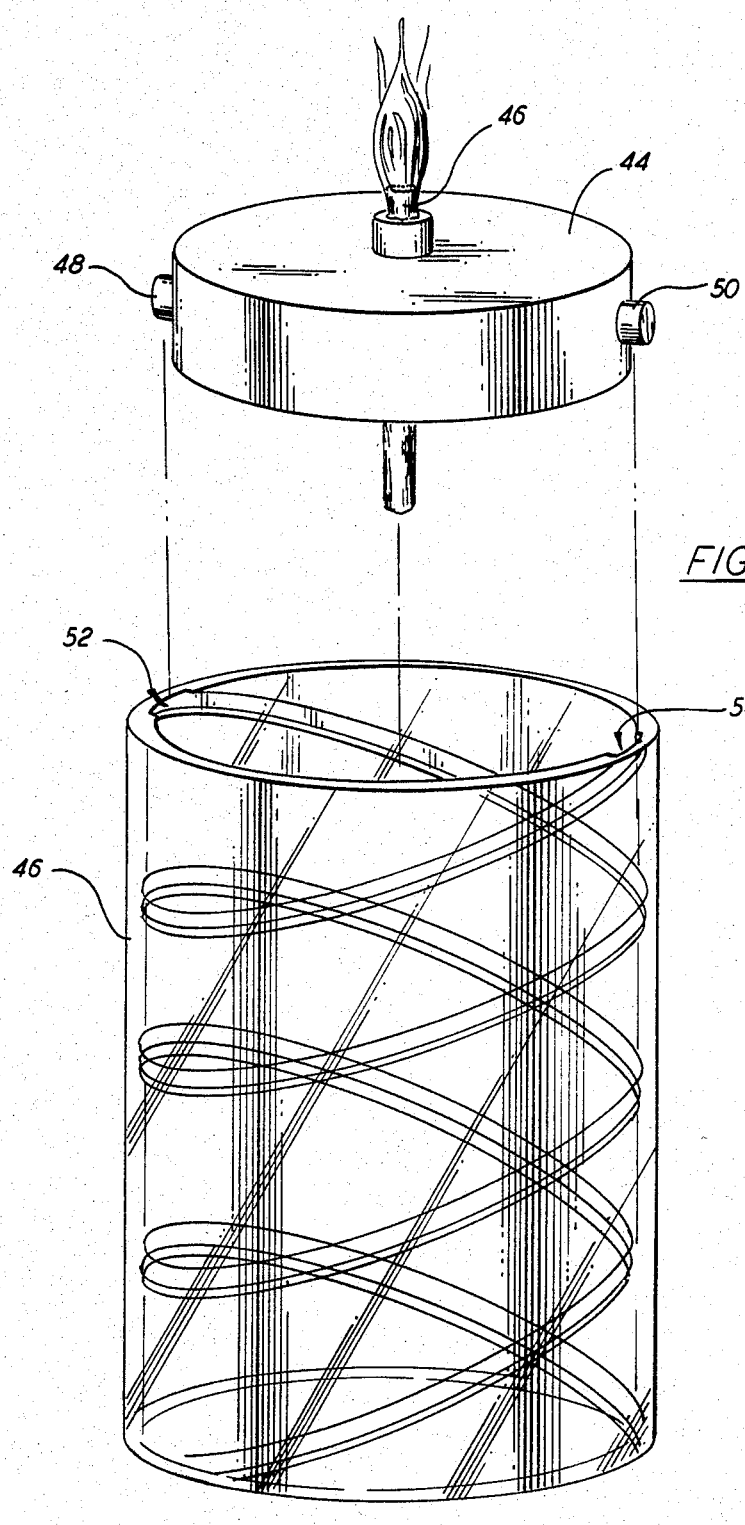
FIG. 4 is a perspective view of another embodiment of the invention.

Turning now to FIG. 4, the invention is illustrated in another embodiment wherein the wick support structure is mounted for rotating movement with respect to the container holding the fuel. The wick support is again shown in the form of a hollow, cylindrical housing 44, having the previously described openings in the top and bottom walls for insertion therethrough of wick 46. While the bottom wall opening may again be sealed by a plug and liquid fuel be placed within housing 44, the present embodiment is particularly adapted to use with container 46. Projecting members 48 and 50 on opposite sides of housing 44 are positioned to mate with spinal grooves 52 and 54 formed on the internal surface of container 46, although internally projecting, spiral tracks would be equally appropriate.

Thus, as the fuel within container 46 is consumed and housing 44 descends therein, the engagement of members 48 and 50 in grooves 52 and 54 causes the housing to rotate. By providing differing pictorial matter on the cylindrical sidewall of housing 44, the portion thereof visible from a fixed position will vary as the fuel is consumed and the housing follows a rotational descending path. If necessary to insure descent on account of frictional considerations, rollers or rotatable sleeves, or the like, may be provided on projecting members 48 and 50.

What is claimed is:

1. A candle construction for use with fuel which is in liquid form at room temperature, wherein the fuel is either internal or external with respect to the candle construction, comprising:

(a) a hollow enclosure having spaced upper and lower walls adapted alternatively to contain a liquid fuel within at least a lower portion thereof, and to float upon a liquid fuel within a container larger than said enclosure;

(b) wick means which said liquid fuel will enter and travel upwardly by capillary action for combustion in an upper area of said wick means;

(c) support means for engaging said wick means and supporting the latter with said upper area thereof above said enclosure and a portion thereof within said enclosure; and (d) said lower wall of said enclosure including an opening through which said wick means may selectively be passed, whereby substantially all the lower end of said wick means may be positioned within said enclosure when said liquid fuel is contained therein, or outside and below said enclosure when the latter is floating upon said liquid fuel, and further including a resilient member having an internal crosss section corresponding to the external cross section of said wick means, whereby the latter substantially seals said opening when extending therethrough.

2. The invention according to claim 1 wherein said lower wall means forms at least a portion of said support means.

3. The invention according to claim 1 and further including a container larger than said enclosure at least partially filled with a liquid fuel, said wick means extending through said opening into said fuel with said enclosure floating thereon.

4. The invention according to claim 3 and further including internal, first guide means on said container, and external, second guide means on said enclosure in mating engagement with said first guide means, whereby said enclosure descends as liquid fuel within said container is consumed in a path established by said guide means.

5. The invention according to claim 4 wherein said path is spiral, whereby said enclosure is rotated by said guide means as it descends within said container.

6. The invention according to claim 1 wherein said hollow enclosure is in the form of a miniature model of a physical object.

7. The invention according to claim 6 wherein said wick means forms a portion of said model, representing portions of said physical object.

8. The invention according to claim 7 wherein said physical object is a steamship and said wick means represent the smokestacks thereof.

9. The invention according to claim 8 wherein said wick means comprise at least one solid rod of charcoal.

* * * * *